US008215993B2

(12) United States Patent
Levy et al.

(10) Patent No.: US 8,215,993 B2
(45) Date of Patent: Jul. 10, 2012

(54) SOCKET

(76) Inventors: Nissim Levy, Netanya (IL); Michael Ratz, Netanya (IL)

( * ) Notice: Subject to any disclaimer, the term of this patent is extended or adjusted under 35 U.S.C. 154(b) by 65 days.

(21) Appl. No.: 12/920,109

(22) PCT Filed: Mar. 2, 2009

(86) PCT No.: PCT/IL2009/000242
§ 371 (c)(1),
(2), (4) Date: Aug. 29, 2010

(87) PCT Pub. No.: WO2009/109968
PCT Pub. Date: Sep. 11, 2009

(65) Prior Publication Data

US 2011/0003491 A1 Jan. 6, 2011

(30) Foreign Application Priority Data

Mar. 3, 2008 (IL) ..... 189892

(51) Int. Cl.
*H01R 24/00* (2011.01)

(52) U.S. Cl. ..... 439/630

(58) Field of Classification Search ..... 439/630–632
See application file for complete search history.

(56) References Cited

U.S. PATENT DOCUMENTS

| | | | | |
|---|---|---|---|---|
| 4,240,030 | A | 12/1980 | Bateman et al. | |
| 4,438,396 | A | 3/1984 | Harnden, Jr. et al. | |
| 5,113,045 | A | 5/1992 | Crofton | |
| 5,423,697 | A * | 6/1995 | MacGregor | 439/638 |
| 5,572,395 | A | 11/1996 | Rasums | |
| 6,145,037 | A * | 11/2000 | Sakakibara | 710/301 |
| 7,721,017 | B2 * | 5/2010 | Estakhri et al. | 710/15 |
| 8,131,902 | B2 * | 3/2012 | Karstens | 710/301 |
| 2004/0070275 | A1 | 4/2004 | Niv | |
| 2005/0198424 | A1 | 9/2005 | Harari et al. | |

FOREIGN PATENT DOCUMENTS

| | | | |
|---|---|---|---|
| CN | 2686148 | Y | 3/2005 |

* cited by examiner

*Primary Examiner* — Truc Nguyen
(74) *Attorney, Agent, or Firm* — Deborah Gador

(57) ABSTRACT

The present invention relates to a socket including a connector insulatedly disposed inside the socket, the connector including contacts electrically connected to a source of input current. The socket further includes a slot for receiving an electronic card in the socket for connecting it to the connector, and a conductor for coupling the connector to at least one blade contact in the socket. According to a preferred embodiment of the present invention, the socket further includes an insulating body defining at least one plug blade receiving slot for disposing the blade contact therein, and a card slot which extends to the connector, and the electronic card is further having contacts complementary to each of the connector contacts.

15 Claims, 2 Drawing Sheets

Versatile Smart Socket and Electronic Card

SOCKET

FIELD OF THE INVENTION

Figure 1A:
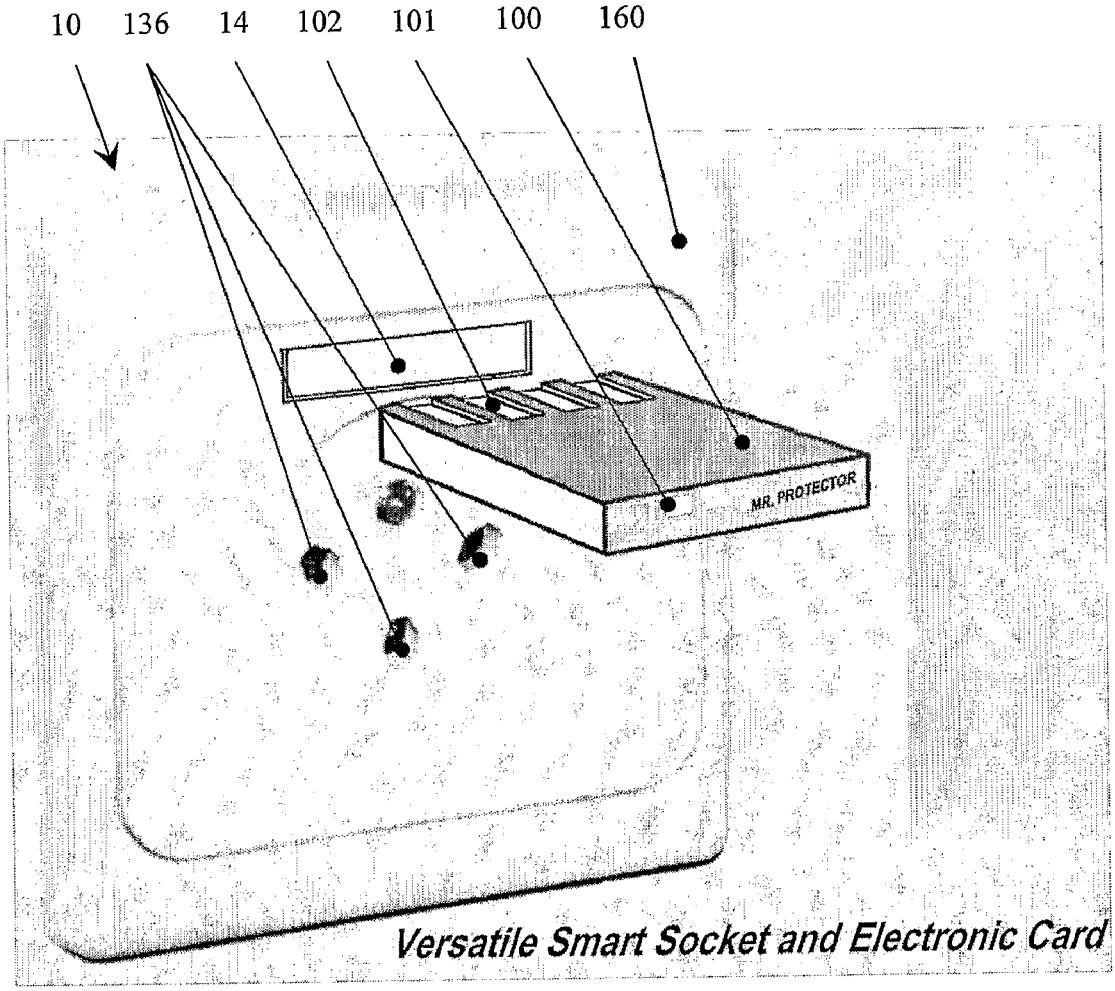

The present invention relates generally to wall sockets, and more particularly to electric and communication sockets.

BACKGROUND OF THE INVENTION

Nowadays, power socket outlets have slots or holes which accept the pins or blades of power plugs inserted into them and deliver electricity to the plugs. Sockets are usually designed to reject any plug which is not built to the same electrical standards, which typically vary in voltage and frequency. There are two main electrical standards, one the North American standard of an alternating current (AC) at 110-120 volts at 60 Hz and the other the European standard of AC at 220-240 volts at 50 Hz. Other countries have adopted one of these two voltage standards, although some countries use variations or a mixture of standards. Since sockets are usually designed to reject any plug which is not built to the same electrical standards, a transformer for adjusting the voltage to a required voltage, and a mechanical adaptor for connecting the socket to the plug of the electrical device, are required. Alternatively, different variations of products can be designed and manufactured, each variation being suited for specific voltage and frequency requirements.

To minimize the difficulty of designing for different national standards, many manufacturers of electrical devices, like personal computers, have adopted the practice of placing a single world-standard IEC (International Electrotechnical Commission) connector on the device, and supplying for each country a power cord equipped with a standard IEC connector on one end and a national power plug at the other. However, the IEC connector must be compatible in its design to fit the plug of the electrical device and the socket. The IEC connector must also be compatible with electrical standards of a designated country.

A surge protector and other types of high voltage protectors are designed to protect electrical devices from voltage spikes. Surge protectors attempt to regulate the voltage supplied to an electric device by either blocking or shorting to ground voltages above a safe threshold. Over time, surge protectors lose their ability to protect against power surges. Most surge protectors are an additional appliance connected between the socket and the electrical device. Therefore, they must be compatible with the socket jacks and the device plugs. There are three important features in a surge protector. First is the clamping voltage, which is the voltage level that will activate the oxide varistors (MOVs) to conduct electricity to the ground line. A lower clamping voltage indicates better protection. There are three levels of protection: 330 V, 400 V and 500 V. For most purposes, a clamping voltage more than 400 V is too high.

The second feature is the energy absorption/dissipation estimation, which is an estimation of how much energy the surge protector can absorb before it fails. A higher number indicates greater protection. A surge, protector should be rated between 200 to 400 joules at least, and at 600 joules or more for better protection. The third feature is the response time. The longer the response time, the longer the plugged electrical device will be exposed to the surge. Therefore, it is essential that the surge protector will respond quickly. In case there is no external high-voltage protector, the device is exposed to voltage spikes which may cause burning of an internal component in the device.

Other types of wall sockets include communication sockets, for transferring data over telephone lines and over data lines. As an example, in the communication networking field, a router is required to extract a destination of a data packet it receives, select the best path to that destination, and forward data packets to the next device along this path. Routers connect networks together, a LAN to a WAN for example, to access the Internet.

There is known from publication CN 2686148, a control panel for a plurality of sockets which includes a slot for a pre-paid card for controlled consumption of electricity. The card includes data indicating the amount of electricity for consumption that has been paid for in advance, like a pre-paid phone card. When the pre-paid card is inserted in the slot, the panel can read the information on the card which indicates the amount of consumption time which has been purchased and is still unused, and switches off the current when the pre-paid time has elapsed. This card does not affect the nature of the current, or the power that passes through the sockets.

Accordingly, there clearly remains a need for a versatile smart socket to which additional features can be added, such as a high-voltage protector or a transformer, which can be replaced or repaired easily and simply, and it would be desirable if the characteristics of the output of the socket could be selected and modified as desired.

SUMMARY OF THE INVENTION

The present invention relates to a socket including a connector insulatedly disposed inside the socket, the connector including contacts electrically connected to a source of input current, a slot for receiving an electronic card in the socket for connecting the electronic card to the connector, and a conductor for coupling the connector to at least one blade contact in the socket.

According to a preferred embodiment of the present invention, the socket further comprises an insulating body defining at least one plug blade receiving slot for disposing the blade contact therein, and a card slot which extends to the connector, and the electronic card is further having contacts complementary to each of the connector contacts.

According to a preferred embodiment of the present invention, the socket further includes a terminal having at least one insulated terminal contact electrically coupled to a conductor carrying the input current and coupled via conducting means to the connector.

According to yet another preferred embodiment of the present invention, the socket further includes an electronic card having electronic circuitry electrically coupled to a source of incoming current. The electronic circuitry us also electrically coupled to the blade plug contact in a plug blade receiving hole in a wall socket for providing a selected outgoing current to the blade contact. The card is adapted and configured to be coupled to the connector in the socket.

According to a preferred embodiment of the present invention, there is provided an electronic card which includes at least one incoming current contact electrically coupled to a source of incoming current, and at least one outgoing current contact electrically coupled to a plug blade contact in a plug blade receiving hole in a wall socket for providing a selected outgoing current to the blade contact. The electronic also includes electronic circuitry coupling the incoming contact and the outgoing contact. This card is adapted and configured to be coupled to complementary contacts in a connector in the wall socket.

According to a preferred embodiment of the present invention, the selected outgoing current from the electronic card is different from the incoming current.

According to yet another preferred embodiment of the present invention, the selected outgoing current from the electronic card is the same as the incoming current.

BRIEF DESCRIPTION OF TILE DRAWINGS

Figure 1B:
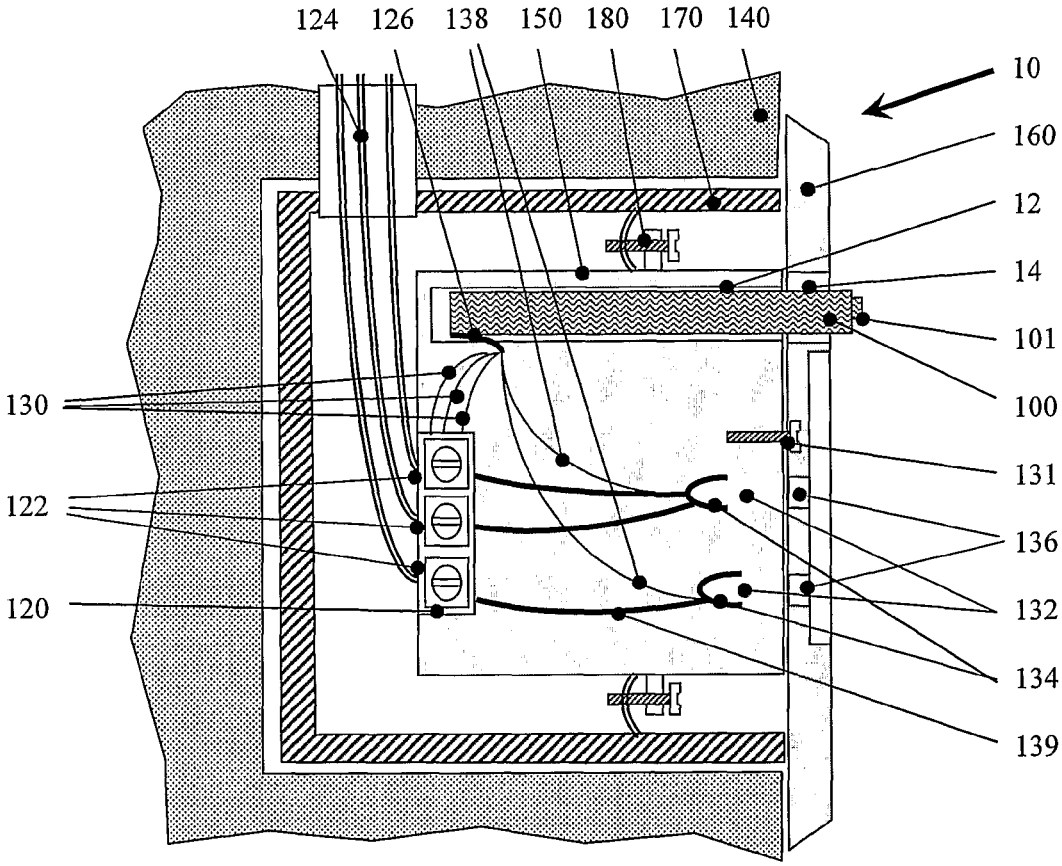
Figure 2:
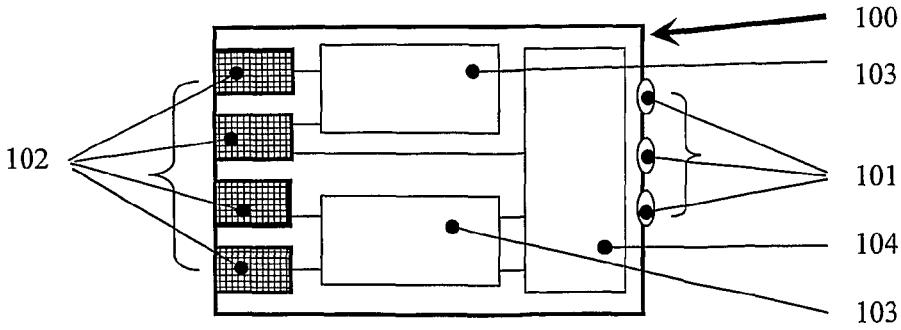

The invention is herein described, by way of example only, with reference to the accompanying drawings, wherein:

FIGS. 1*a* and 1*b* are respective front and schematic side sectional illustrations of a wall socket constructed and operative according to one embodiment of the invention; and FIG. 2 is an illustration of an electronic card with a connector for a wall socket, according to one embodiment of the present invention.

DETAILED DESCRIPTION OF THE INVENTION

The present invention relates to sockets, particularly electrical and communications wall sockets, having a slot to receive an electronic card for converting the socket to a versatile smart socket. The electronic card typically includes a printed circuit board, having various electrical components, such as integrated circuits, for performing various electronic functions, and is adapted for insertion into a complementary connector in the socket to provide additional features to conventional sockets. It will be appreciated that, if no smart features are required, a dummy card may be inserted in the socket permitting current to flow unchanged through the card and to the plug blade contacts of the socket, allowing the socket to function as a conventional socket.

The principles and operation of a wall socket, which can be mounted on a wall or affixed in a wall, and an associated electronic card, according to the present invention, may be better understood with reference to the drawings and the accompanying description.

Before explaining embodiments of the invention in detail, it is to be understood that the invention is not limited in its application to the details of design and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Further, where considered appropriate, reference numerals may be repeated among the figures to indicate corresponding or analogous elements.

Reference is made to FIGS. 1*a* and 1*b*, perspective and schematic side sectional illustrations, respectively, of a socket (10), according to one embodiment of the present invention. Socket (10) includes a receptacle (170) for mounting in a wall, as known, and an insulating body (150) mounted in receptacle (170), as by clips (180). Receptacle (170) is covered by a front panel (160) defining an aperture (14) and a plurality of plug blade receiving holes (136).

In this embodiment, a terminal (120), having at least one, and preferably a plurality of terminal contacts (122), is coupled to insulating body (150). Terminal contacts (122), which are insulated from one another, are electrically coupled to conductors (124), such as wires, carrying mains electricity or data. A plurality of wires (130), or other conducting means, extend from contacts (122) on terminal (120) to a connector (126) mounted in a slot (12), described in detail below, in insulating body (150). Additional conductors (138) are coupled from connector (126) to at least one plug blade contact (134), which are disposed in slots (132) in insulating body (150) for receiving the blades of a plug plugged into the socket. Conductors 138 provide electricity or data to the blades of the plug plugged into the holes (136) of the socket.

According to some embodiments of the invention, such as when the card and socket are designed to protect a device plugged into the socket from a power surge, at least one conductor 139, such as a wire, also is coupled directly from at least one of the contacts (122) in terminal (120) to at least one of the blade contacts (134) in slots (132). Connector (126) is also coupled via conductors such as wiring (138) to at least one of blade contacts (134) in plug blade slots (132). In this way terminal 120, and/or connector (126) receive and transfer electrical current via incoming wiring and outgoing wiring.

Socket (10) further includes an electronic card slot (12), here illustrated in insulating body (150), accessible via aperture (14) in front panel (160). Electronic card slot (12) extends in insulating body (150) to the connector contacts of the connector (126). An associated electronic card (100) can be inserted into slot (12) through aperture (14) to contact the connector contacts on connector (126). Electronic card (100) may be a smart card, having electronic components for changing the incoming current to a desired outgoing current, or may be a dummy card, allowing the incoming current to pass through the card unchanged.

One embodiment of an electronic card (100) is shown in FIG. 2. Electronic card (100) includes a plurality of contacts (102) complementary to the connector contacts in connector (126). Contacts (102) are insulated from one another and configured to fit into connector (126) for electrically contacting the connector contacts. Electronic card (100) preferably includes at least one LED (101), and preferably a plurality thereof, for providing various indications, as desired. Such LEDs can be used, if desired, as indicators or warning signals. For example, such LED can be used to indicate the presence of current flow, a shortage in power supply, short circuit, exceeding of standard power consumption and disruption or disconnection in the networking communication, or any other feature desired in the versatile smart socket.

When contacts (102) of electronic card (100) electrically engage the connector contacts in connector (126), electronic card (100) receives electrical current (i.e., power or data) from wires (130) via terminal (120) and connector (126). Connector contacts in connector (126) receive input current or data from wires (130) and transfer output current and/or data to blade contacts (134) in plug blade slots (132) through wires (138). The electronic card (100) is adapted and configured to modify the characteristics of the input current, as desired, and provides output current according to selected electrical current parameters, such as voltage, frequency or data routings, to contacts (134).

According to different embodiments of the present invention, electronic card (100) may include electronic circuitry (103) for achieving desired socket features, for example, a wireless router for a data socket, surge protection units, transformer circuitry, etc., to affect the output current of the socket for the desired use. Electronic card (100) further may include a control unit (104), such as a CPU, for controlling the performance of the electronic circuitry (103). Additionally, one or more LEDs (101) may be mounted in the electronic card for signal warnings, as described above.

One preferred embodiment of the invention includes an electronic card providing surge protection, to prevent damage from high-voltage spikes to an electrical device plugged into the socket. The surge protection feature will prevent voltage spikes from passing to the electrical device. More specifically, the electronic card can be adapted and configured to filter undesired voltage levels or frequencies from passing to the electrical device. The electronic card integrated within the smart socket may include any components commonly utilized in surge protectors. In a severe case, when the voltage entering the electronic card exceeds its threshold voltage and damages the card, the card can either be repaired or replaced without any intervention to the socket itself or to the electrical device which was plugged therein.

The electronic card is also capable of adjusting the voltage output of the socket. More specifically, the electronic card can function as a transformer and adjust the voltage supplied to an electrical device plugged into the socket so as to meet the requirements of the electrical device. Furthermore the electronic card may also act as a rectifier, changing alternating current (AC) to direct current (DC) of any desired voltage, as required by many electrical devices. Alternatively, the electronic card may alter the frequency of the electrical current according to the requirements of the electrical device.

In communications sockets, circuitry can be provided on the electronic card to serve as a router, amplifier, encoder or decoder, and so forth.

It will be appreciated that the electronic card may have circuitry for performing more than one function, such as rectifying as well as power surge protection. Alternatively, the functions need not be related and switching between functions can be accomplished by the user, either manually, as by an external electric switch, or by remote control, with proper electronic arrangement on the card. In fact, switching a device plugged into the socket on and off can be accomplished remotely or locally by means of the card. Thus, permitting or preventing passage of current effectively turns the device on or off, as desired.

It will further be appreciated that, in case it is desired that the output current is the same as the input current, a dummy card Can be inserted in the slot in the socket, in lieu of a card with electronic circuitry that changes the current. If desired, a dummy card can be used as an on/off switch, with proper circuitry, for manually or remotely turning the device on or off.

Another feature of the present invention is displaying warnings, such as short circuit due to deficiency in the electrical current, electrical power interruption and burning of an electrical fuse. The electronic card may be adapted and configured to provide the aforementioned features by either the manufacturer of the card prior to inserting the electronic card into the socket or by the user thereafter. The electronic card may include electronic means for remote programming, as known, which can permit the user to remotely adjust the aforementioned electric features of the card after insertion into the socket while it is in the slot.

According to yet another embodiment, the electronic card of the present invention can be provided with means for data measurements, such as power consumption measurements, as known, which may be displayed on a screen on front panel (160) or on the card.

While one preferred embodiment involves a smart wall socket, alternatively, the invention can be utilized in a power or data inlet or outlet socket of a computer or similar instrument, where it is desired to modify the input current or provide surge protection in the power inlet socket. In this way, it is possible to create a smart socket or jack also in various instruments. In such a case, the smart jack corresponds to the plug blade slot.

According to yet another embodiment of the invention, the socket need not include a terminal. Rather, the mains electricity or incoming data current passes directly to the connector which, in turn, is electrically coupled to the electronic card and, also is electrically coupled to the blade contacts.

While the invention has been described above with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. An electronic card for use with an electric socket, said socket including:

an insulating socket body having an aperture and at least one plug blade slot;

at least one plug blade contact disposed in each said plug blade slot, said plug blade contact being arranged to contact a plug blade of a plug of an electric device;

an electrical connector disposed inside the socket body and electrically coupled to each said plug blade contact and electrically connected to a source of voltage or current; and a slot in said insulating socket body, extending from said aperture to said electrical connector, arranged to removably receive an electronic card removably inserted through said aperture into said electrical connector for electrically connecting said electronic card to said electrical connector;

said electronic card affecting a characteristic of the voltage or current from said source of voltage or current at said plug blade contact;

the electronic card comprising:

at least a first card contact electrically couplable to the source of incoming current or voltage;

at least a second card contact electrically couplable to said plug blade contact; and at least one conductor coupling said first and second card contacts and electrically coupling said source of voltage or current to said plug blade contact.

2. The electronic card according to claim 1, wherein the voltage or current at said plug blade contact is different from the voltage or current at the source of voltage or current.

3. The electronic card according to claim 1, wherein said at least one conductor is electronic circuitry.

4. An electric socket comprising:

an insulating socket body having an aperture and at least one plug blade slot;

a plug blade contact disposed in each said at least one plug blade slot, said plug blade contact arranged to contact a plug blade of a plug of an electric device;

an electrical connector disposed inside said insulating socket body, said electrical connector being electrically coupled to said plug blade contact and electrically connected to a source of voltage or current; and a slot in said insulating socket body, extending from said aperture to said electrical connector, arranged to removably receive an electronic card removably inserted through said aperture into said electrical connector for electrically connecting said electronic card to said electrical connector;

said electronic card affecting a characteristic of the voltage or current from said source of voltage or current at said plug blade contact.

5. The electric socket according to claim 4, further comprising a terminal electrically coupled to the source of voltage or current and electrically coupled to said electrical connector.

6. The electric socket according to claim 4, wherein said electronic card comprises:

electronic circuitry; and card contacts for electrically coupling said electronic circuitry to said electrical connector.

7. An electric socket comprising:

an insulating socket body having an aperture and at least one plug blade slot;

a plug blade contact disposed in each said at least one plug blade slot, said plug blade contact arranged to contact a plug blade of a plug of an electric device;

an electrical connector disposed inside said insulating socket body;

a slot in said insulating socket body extending from said aperture to said electrical connector arranged to removably receive an electronic card removably inserted through said aperture into said electrical connector for electrically connecting said electronic card to said electrical connector;

said electrical connector including at least one input contact and at least one output contact, one of said input contacts being electrically connected to a source of voltage or current;

at least one of said output contacts of said electrical connector being electrically connected to said plug blade contact disposed in one said plug blade slot for providing voltage or current thereto;

said at least one input contact on said electrical connector and said at least one output contact on said electrical connector being electrically connectable through at least one conductor in an electronic card that is connected to said electrical connector.

8. The socket according to claim 4, further comprising a terminal electrically coupled to the source of voltage or current and electrically coupled to said electrical connector.

9. The socket according to claim 4, wherein said electronic card comprises:

electronic circuitry; and card contacts for electrically coupling said electronic circuitry to said electrical connector.

10. The socket according to claim 9, wherein a voltage or current at said plug blade contact is the same as the voltage or current at the source of voltage or current.

11. An electronic card for use with an electric socket, said socket including:

an insulating socket body having an aperture and at least one plug blade slot;

a plug blade contact disposed in each said at least one plug blade slot, said plug blade contact arranged to contact a plug blade of a plug of an electric device;

an electrical connector disposed inside said insulating socket body;

a slot in said insulating socket body extending from said aperture to said electrical connector arranged to removably receive an electronic card removably inserted through said aperture into said electrical connector for electrically connecting said electronic card to said electrical connector;

said electrical connector including at least one input contact and at least one output contact, one of said input contacts being electrically connected to a source of voltage or current;

at least one of said output contacts of said electrical connector being electrically connected to said plug blade contact disposed in one said plug blade slot for providing voltage or current thereto;

said at least one input contact on said electrical connector and said at least one output contact on said electrical connector being electrically connectable through at least one conductor in an electronic card that is connected to said electrical connector;

the electronic card comprising:

at least a first card contact electrically couplable to the source of incoming current or voltage;

at least a second card contact electrically couplable to said plug blade contact; and at least one conductor coupling said first and second card contacts and electrically coupling said source of voltage or current to said plug blade contact.

12. The electronic card according to claim 11, wherein the voltage or current at said plug blade contact is the same as the voltage or current at the source of voltage or current.

13. A method for electrically coupling a source of voltage or current to at least one plug blade contact in an electric socket for providing voltage or current to the plug blade contact, the method comprising:

providing an insulating socket body having an aperture and at least one plug blade slot;

disposing a plug blade contact in each said at least one plug blade slot, said plug blade contact being arranged to contact a plug blade of a plug of an electric device;

mounting an electrical connector inside said insulating socket body;

defining a card slot in said insulating socket body extending from said aperture to said electrical connector;

connecting electrically said electrical connector to a source of voltage or current;

connecting electrically said electrical connector to said at least one plug blade contact for providing voltage or current thereto; and connecting electrically an electronic card replaceably inserted through said aperture to said electrical connector.

14. The method according to claim 13, further comprising:

connecting electrically at least one input contact of said electrical connector to the source of voltage and current and electrically connecting at least one output contact of said electrical connector to said plug blade contact; and connecting electrically said at least one input contact of said electrical connector to said at least one output contact of said electrical connector through said electronic card.

15. The method according to claim 14, wherein said electronic card modifies at least one characteristic of current or voltage passing therethrough from said at least one input contact to said at least one output contact.

* * * * *

UNITED STATES PATENT AND TRADEMARK OFFICE

CERTIFICATE OF CORRECTION

PATENT NO. : 8,215,993 B2
APPLICATION NO. : 12/920109
DATED : July 10, 2012
INVENTOR(S) : Nissim Levy et al.

It is certified that error appears in the above-identified patent and that said Letters Patent is hereby corrected as shown below:

Column 7, line 34, cancel the text beginning with, "8. The socket", and ending with, "voltage or current", in column 7, line 44, and insert the following claims:

--8. The socket according to claim 7, further comprising a terminal electrically coupled to the source of voltage or current and electrically coupled to said electrical connector.

9. The socket according to claim 7, wherein said electronic card comprises:
electronic circuitry; and
card contacts for electrically coupling said electronic circuitry to said electrical connector.

10. The socket according to claim 7, wherein a voltage or current at said plug blade contact is the same as the voltage or current at the source of voltage or current.--

Signed and Sealed this
Eleventh Day of September, 2012

David J. Kappos

David J. Kappos
*Director of the United States Patent and Trademark Office*